United States Patent [19]

Lok

[11] Patent Number: 5,056,230

[45] Date of Patent: Oct. 15, 1991

[54] ELLIPSOGRAPH STRUCTURE

[76] Inventor: Yuk L. Lok, 33-39 73rd St., Jackson Hts., Queens, N.Y. 11372

[21] Appl. No.: 616,912

[22] Filed: Nov. 21, 1990

[51] Int. Cl.[5] ..... B43L 11/04

[52] U.S. Cl. ..... 33/30.1

[58] Field of Search ..... 33/30.1, 30.4, 31

[56] References Cited

U.S. PATENT DOCUMENTS

| | | | |
|---|---|---|---|
| 000,312 | 2/1987 | Burstow . | |
| 655,538 | 8/1900 | Worth . | |
| 717,082 | 12/1902 | Dart . | |
| 880,228 | 2/1908 | Looyer | 33/31 |
| 957,114 | 5/1910 | Shea | 33/30.1 |
| 2,156,417 | 5/1939 | Witherspoon | 33/31 |
| 3,237,309 | 3/1966 | Vogel . | |
| 4,182,043 | 1/1980 | Nemoto . | |

FOREIGN PATENT DOCUMENTS

| | | |
|---|---|---|
| 72710 | 3/1916 | Austria . |
| 519857 | 2/1955 | Italy . |
| 241919 | 4/1947 | Switzerland . |
| 290611 | 5/1953 | Switzerland . |
| 168890 | 4/1965 | U.S.S.R. . |

*Primary Examiner*—Harry N. Haroian

*Attorney, Agent, or Firm*—Leighton K. Chong

[57] ABSTRACT

An ellipsograph structure has first and second arms coupled by pin connections to each other and to a rotatable driving member slidably mounted on a member extending between end supports along a longitudinal axis. A straight line motion mechanism is mounted to one of the end supports for constraining movement of the pin connection between the first and second arms on a straight line along a transverse axis. The straight line motion mechanism includes a pivot member mounted at a fixed pivot point along the longitudinal axis, an extension member in alignment with the longitudinal axis, a swing arm pivotally coupled to the end of the extension member, and a longer guiding arm with one end pivotally coupled to the end of the swing arm and its opposite end pivotally coupled to the pin connection between the first and second arms. The pivot member has a retaining channel in which the guiding arm is slidably retained for sliding movement at all times intersecting the pivot point in conjunction with rotation of the driving member and movement of the pin connection of the arms along the transverse axis.

20 Claims, 5 Drawing Sheets

ELLIPSOGRAPH STRUCTURE

FIELD OF THE INVENTION

This invention generally relates to an instrument or tool for drawing or tracing an ellipse, and particularly to one having an improved structure for greater stability and ease of use.

BACKGROUND ART

Drawing instruments or cutting tools have been proposed with various mechanical structures for making the drawing or tracing of an ellipse easier and more accurate than the typical manual method of tracing with curved templates. Particularly, it is desireable to draw an ellipse in one complete rotation, rather than compounding partial curves, in order to draw an ellipse with a smooth, uniform line that returns accurately to its starting point.

As one example, shown in U.S. Pat. No. 4,182,043 to Nemoto, a driving member is slidably supported on a pair of rails mounted on a pair of spaced apart stanchions. The rails extend along a longitudinal axis of the ellipse to be drawn. The driving member is slidably coupled in a slot in one end of a first arm for driving the arm in rotation. The other end of the first arm is connected by a pin to one end of a second arm, and a drawing stylus is fixed to the other end of the second arm. A pair of supporting arms, having their ends coupled to spur gears movable about respective bevel gears, extend symmetrically from the stanchions and are rotatably coupled to the pin in order to constrain the movement of the pin along a tranverse axis of the ellipse. An ellipse is drawn by rotating the driving member one complete rotation. The position of the coupling of the driving member in the slot can be adjusted to set the diameter of the ellipse along its transverse axis, and the position of the stylus on the second arm can be adjusted to set the diameter along the longitudinal axis.

However, this type of ellipsograph structure has several significant problems. The spur and bevel gear construction for movably supporting the ends of the supporting arms is quite complicated to manufacture, assemble, or disassemble. Further, the range of ellipses that can be drawn is limited by the fixed spacing of the two end stanchions and the chosen dimensions of the supporting arms, spur gears, and bevel gears. Moreover, the center of the ellipse is constrained at the midpoint of the two end stanchions, making it difficult to use the ellipsograph in circumstances where the two end stanchions cannot be positioned over the area where the ellipse is to be drawn. Another ellipsograph structure, as disclosed in U.S. Pat. No. 3,237,309 to Vogel, uses an epicyclic gear and a sliding transverse tube to support the second (drawing) arm, but has similar limitations as the Nemoto structure.

In U.S. Pat. No. 2,156,417 to Witherspoon, an ellipsograph structure has the pin axis between the first and second arm contrained along the transverse axis by a straight line motion mechanism which is mounted from only one end stanchion. This overcomes the limitation on the range of ellipses that can be drawn, and also allows drawing over desired areas without constraint from any required placement of the other end stanchion. However, the Witherspoon straight line motion mechanism is very complex in construction, having a fixed pivot point, a free swing point, and scissors-type pairs of arms movably biased by a tension spring mounted from the one end stanchion. This complicated structure would be difficult to manufacture and assemble, and to disassemble for replacement with a motion mechansim of different dimensions.

SUMMARY OF THE INVENTION

It is therefore a principal object of the invention to provide an improved ellipsograph structure which is not limited as to the range of ellipses that can be drawn and, in particular, has a straight line motion mechanism mounted from one end thereof which is very simple in construction, such that it can be readily and inexpensively manufactured and assembled, as well as disassembled for replacement with a motion mechansim of different dimensions.

In accordance with the present invention, an ellipsograph structure comprises a pair of end supports, a longitudinal member extending therebetween along a longitudinal axis over an area where an ellipse is to be drawn, a carriage member slidably supported on said longitudinal member and having a rotatable driving member mounted thereon, wherein upon rotation said driving member supported on said carriage can freely slide on said longitudinal member along said longitudinal axis, a first arm and a second arm, said first arm having one end thereof fixedly coupled by a first pin connection to said driving member and an opposite end fixedly coupled by a second pin connection to one end of said second arm, a stylus fixed to an opposite end of said second arm, and a straight line motion mechanism mounted to one of said end supports for constraining movement of the second pin connection between said first and second arms on a straight line along a transverse axis perpendicular to said longitudinal axis upon rotation of said driving member, wherein said straight line motion mechanism includes a pivot member mounted on said one end support at a fixed pivot point along said longitudinal axis, an extension member mounted to said one end support having a distal end extending a first length therefrom in alignment with said longitudinal axis, a swing arm having a second length with one end thereof pivotally coupled to said distal end of said extension member, and a guiding arm having a third length longer than the sum of said first and second lengths with one end thereof pivotally coupled to an opposite end of said swing arm and an opposite end thereof pivotally coupled to said second pin connection between said first and second arms, said pivot member having a retaining channel formed therein intersecting said pivot point in which said guiding arm is slidably retained for sliding movement at all times intersecting said pivot point in conjunction with rotation of said driving member and movement of said second pin connection along said transverse axis.

In the preferred embodiment of the ellipsograph, a crank handle is coupled to the first pin connection for rotating the first and second arms for drawing the ellipse, and has a hinge for folding to a storage position. The carriage member is slidably carried on a pair of longitudinal rails. Slide blocks and screw or clamp members are provided on the first and second arms for adjusting the distance position of the second pin connection from the first pin connection, and of the stylus from the second pin connection, in order to draw ellipses of different dimensions.

Other objects, features and advantages of the present invention will be apparent from the following detailed description of the preferred embodiments with reference to the drawings, of which:

DETAILED DESCRIPTION OF THE INVENTION

Figure 1:
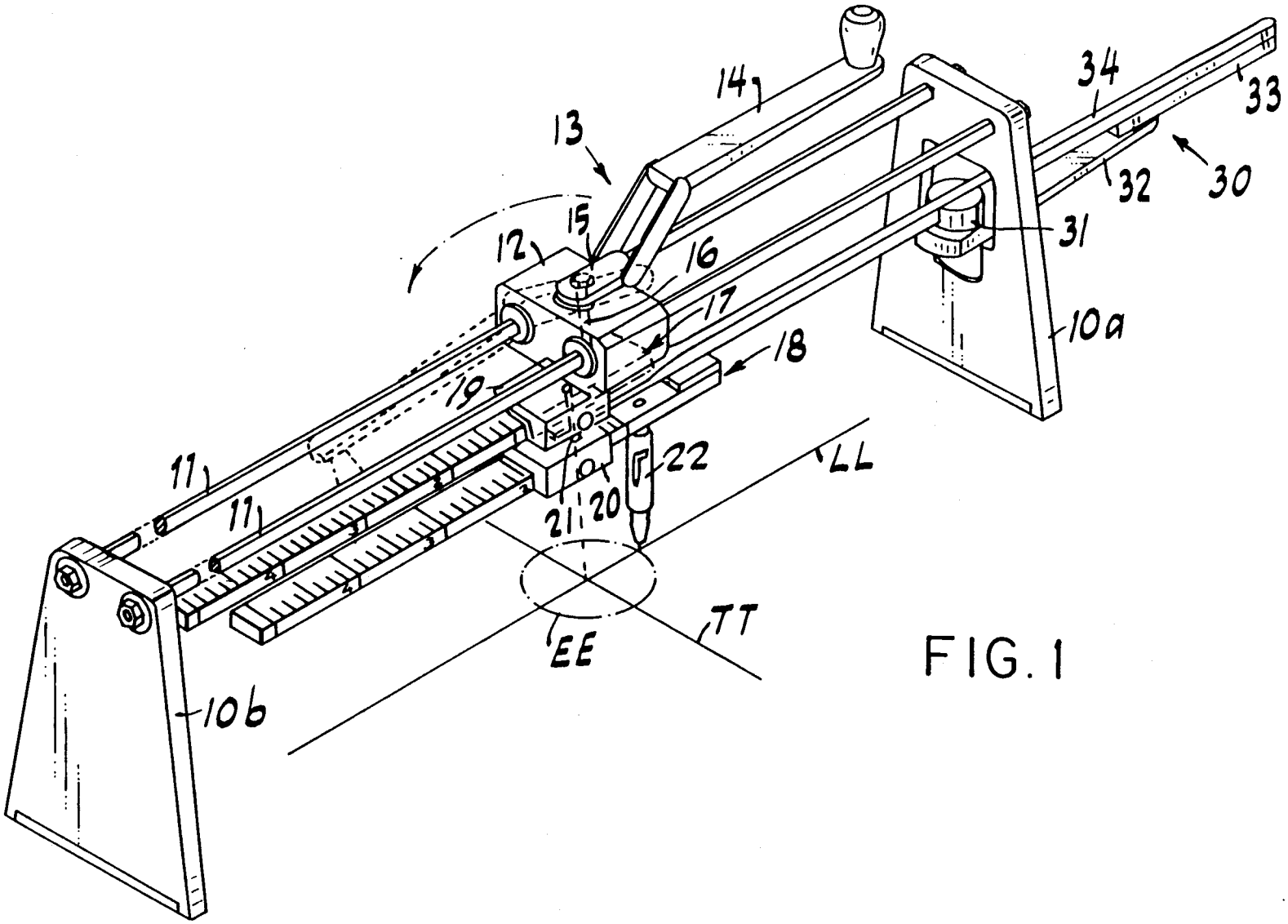
FIG. 1 is a perspective view of an ellipsograph structure in accordance with the present invention.

Referring to FIG. 1, an ellipsograph structure has a pair of end supports 10*a* and 10*b* with longitudinal rails 11 extending therebetween along a longitudinal axis indicated by the line LL. The longitudinal rails are shown in broken section at the near end of the drawing to indicate that the rails may be of any desired length to allow ellipses to be drawn over any desired area. A carriage member 12 is slidably supported on the longitudinal rails by slide bores formed therethrough. A rotatable driving member, indicated generally by the numeral 13, is mounted to the carriage member 12. The driving member includes a handle 14 coupled to a crank portion 15, and a driving pin 16 fixedly connected to the crank portion 15 and to a first arm (described further below). The driving member 13 can freely slide via the carriage member 12 on the longitudinal rails 11 along the longitudinal axis LL when the handle 14 is rotated. The handle 14 is hinged to the crank portion for folding it down to a storage position (indicated by the dashed arrow and phantom lines) when the ellipsograph is to be stored or is not in use.

The driving member 13 is fixedly coupled via the driving pin 16 extending through the carriage member 12 and into one end of a first arm 17. A collar 16*b* and compression spring 16*c* is provided for lifting the stylus, as explained in more detail hereinafter. An opposite end of the first arm 17, delimited by the position of an adjustable block 19, is fixedly coupled by a coupling pin 21 to one end of a second arm 18, which is delimited by the position of another adjustable block 20. On an opposite end of the second arm 18 is a stylus 22 for drawing or cutting an ellipse EE below the described structure. The position of the coupling pin 21 between the first and second arms 17 and 18 from the driving pin 16 can be adjusted by loosening the thumbscrew on the block 19 and sliding it along the distal end of the first arm 17 to a new position. Similarly, the position of the stylus 22 from the coupling pin 21 can be adjusted by loosening the thumbscrew on the block 20 and sliding the second arm 18 through the block 20 to a new position. The first and second arms are shown having marked gauges along their lengths so that the exact measurements of the two positions can be read off conveniently. The two measurements determine the major and minor radii of the ellipse EE.

The ellipsograph has a straight line motion mechanism 30 mounted to one end support 10*a* for constraining movement of the coupling pin 21 between the first and second arms on a straight line along the transverse axis TT perpendicular to the longitudinal axis TT upon rotation of the driving member 13. The straight line motion mechanism includes a pivot member 31 mounted at a fixed pivot point aligned with the longitudinal axis LL, an extension member 32 mounted to the one end support 10*a* in alignment with the longitudinal axis LL, a swing arm 33 having one end pivotally coupled to a distal end of the extension member, and a guiding arm 34 having one end pivotally coupled to an opposite end of the swing arm 33 and an opposite end pivotally coupled to the coupling pin 21 between the first and second arms 17 and 18. The extension member 32 can have a portion for mounting the pivot member 31 thereon, so that the entire assembly can be mounted as an integral unit to the end support with the guiding arm extending through a window aperture formed therein.

Referring to FIGS. 2 and 5A–5D, the positions of the parts of the ellipsograph will now be described for the drawing of an ellipse. The position P2 of the coupling pin 21 is constrained by the straight line motion mechanism 30 to lie on the transverse axis TT. As the handle 14 is rotated, the driving pin 16 starts to rotate the connected end of the first arm 17, thereby moving the position P2 of the coupling pin 21 out along the transverse axis TT. The carriage member 12 (and the position P3 of the driving pin 16) freely slides along the longitudinal rails 11 in conjunction with this driving movement. The position Pl of the stylus 22 begins to revolve around the center of the ellipse EE at the intersection of the longitudinal axis LL and transverse axis TT. As one revolution of the handle 14 is completed, the parts of the ellipsograph are returned to their initial positions shown in FIG. 2. Thus, the distance RT set between the driving pin 16 and the coupling pin 21 determines the radius of the ellipse EE along the transverse axis TT, and the distance RL between the coupling pin 21 and the stylus 22 determines the radius along the longitudinal axis LL. If RT is greater than RL, then the ellipse will have its major radius along the transverse axis TT, whereas if RL is greater than RT, then the ellipse will have its major radius along the longitudinal axis LL. If RT is set equal to RL, a circle of like radius will be drawn.

Figure 2:
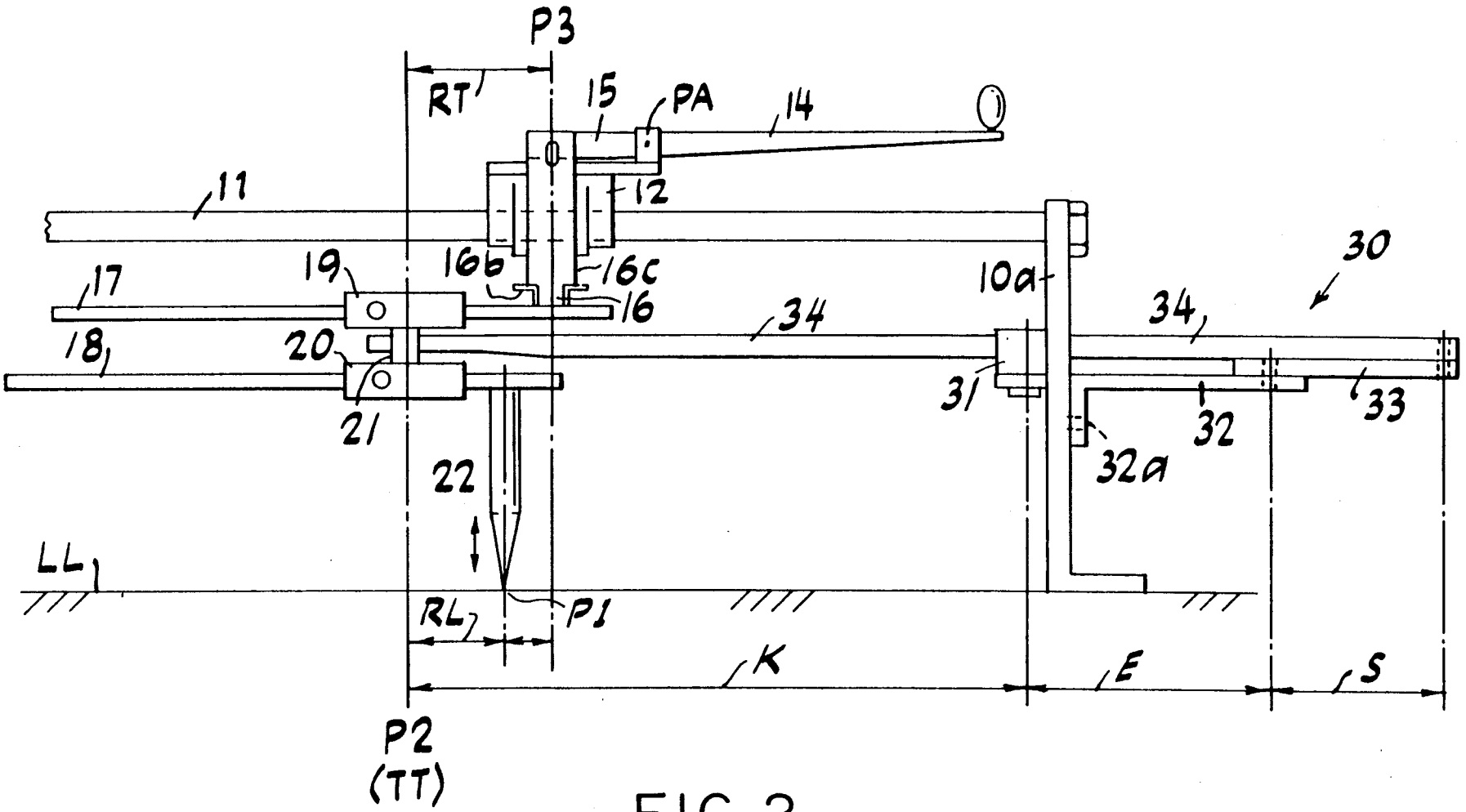
FIG. 2 is a side schematic view of the ellipsograph structure shown in FIG. 1.

Thus, a wide range of ellipses can be drawn simply by setting the positions of the blocks 19 and 20 along the arms 17 and 18. The maximum extent of ellipse dimensions can be extended by increasing the lengths of the arms. The ellipse dimensions and/or the area over which the ellipse is drawn can also be extended by extending the length of the guiding arm 34. In FIG. 2, the guiding arm has a length equal to the length E of the extension member 32, the length S of the swing arm 33, and the distance K between the position of the coupling pin 21 and the pivot member 31.

Figure 3:
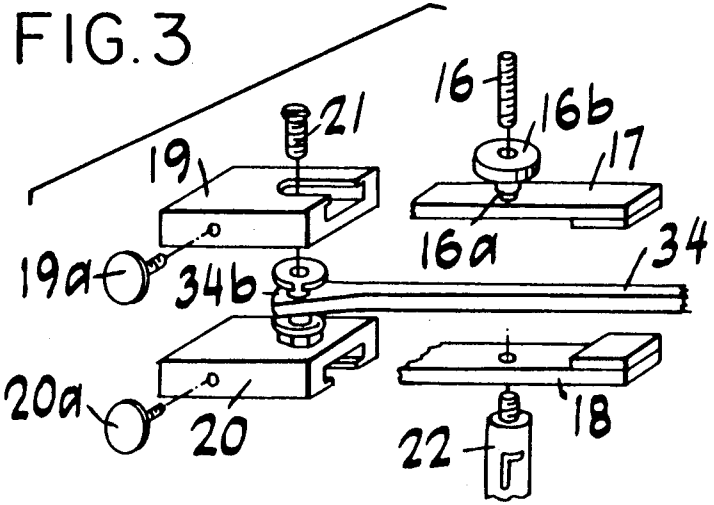
FIG. 3 is an exploded view of the pin connections between the arms of the ellipsograph structure of the present invention.

As shown in FIG. 3, the first and second arms can be formed and assembled by threading the driving pin 16 in a threaded hole 16*a* formed in the end of the first arm 17. The coupling pin 21 is inserted through a hole in the bottom wall of the block 19 and through a retaining hole 34*b* in the end of the guiding arm 34, and threaded into a threaded hole in the upper wall of the block 20. Thumbscrews 19*a* and 20*a* for adjustment of the blocks 19 and 20 are also shown. The stylus 22 can have a threaded end which attaches into a threaded hole in the end of the second arm.

Figure 4:
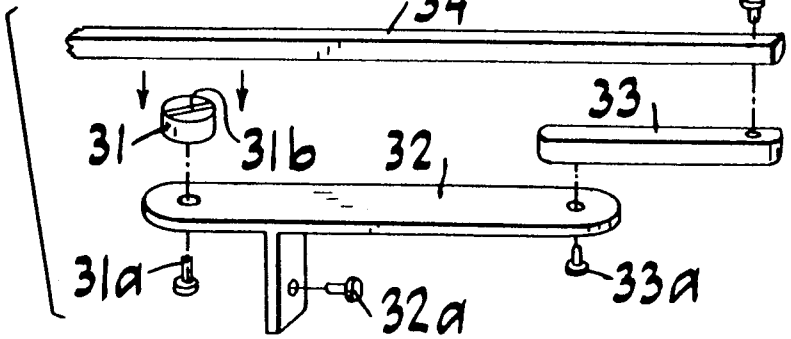
FIG. 4 is an exploded view of the straight line motion mechanism used in the present invention.

In FIG. 4, a pivot pin 31*a* is inserted through one end of the extension member 32 into the pivot member 31, so that the pivot member is secured to the extension member as a base while remaining freely pivotable. A screw 32*a* secures the extension member 32 to the end support 10*a*. A pivot pin 33*a* holds one end of the swing arm 33 to the distal end of the extension member 32 so that it is freely pivotable thereon. A pivot pin 34*a* holds one end of the guiding arm 34 to the opposite end of the swing arm 33. The pivot member 31 is formed as a cylindrical block. A retaining channel 31*b* is formed in the upper part of the pivot member 31, and the guiding arm is retained in and freely slidable along this retaining channel 31*b*.

Figure 6:
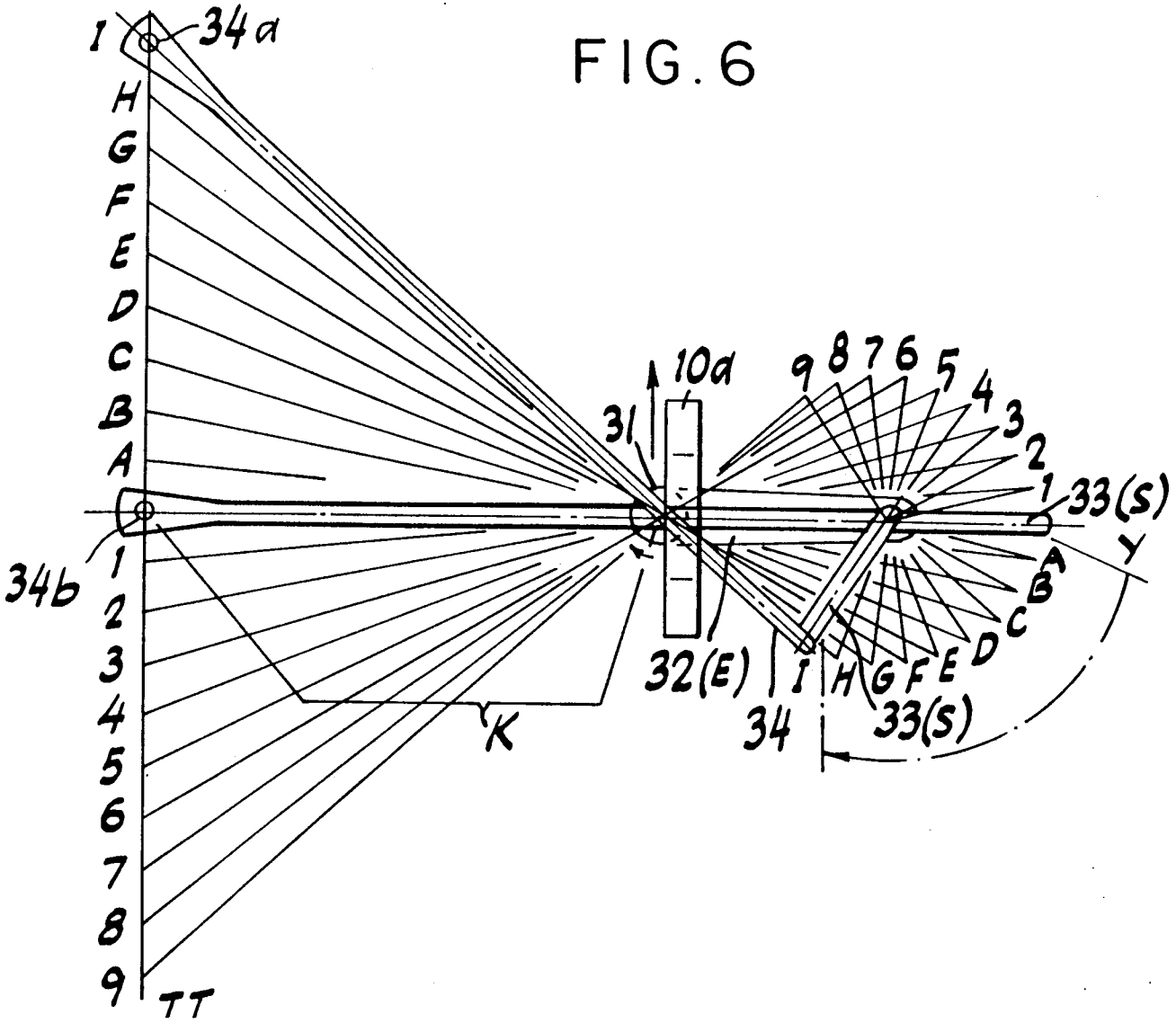
FIG. 6 is a diagram illustrating the radius geometry of the straight line motion mechanism.
Figure 5A:
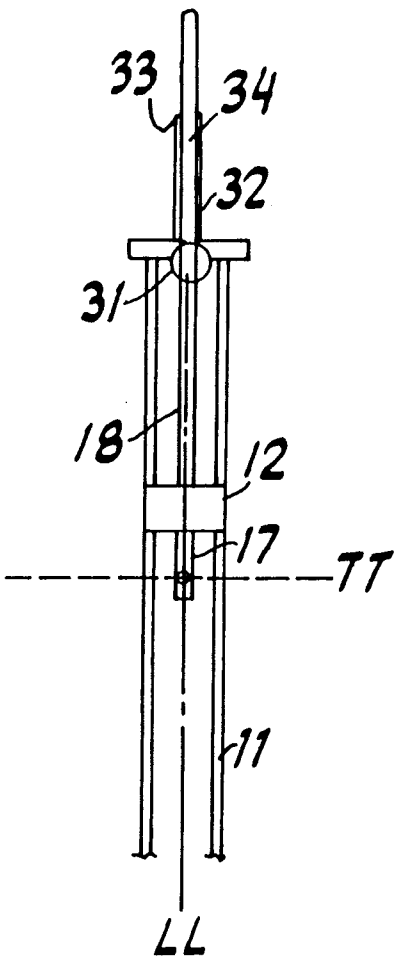
FIGS. 5A, 5B, 5C, and 5D illustrate the positions of the arms and straight line motion mechanism for drawing an ellipse.
Figure 5D:
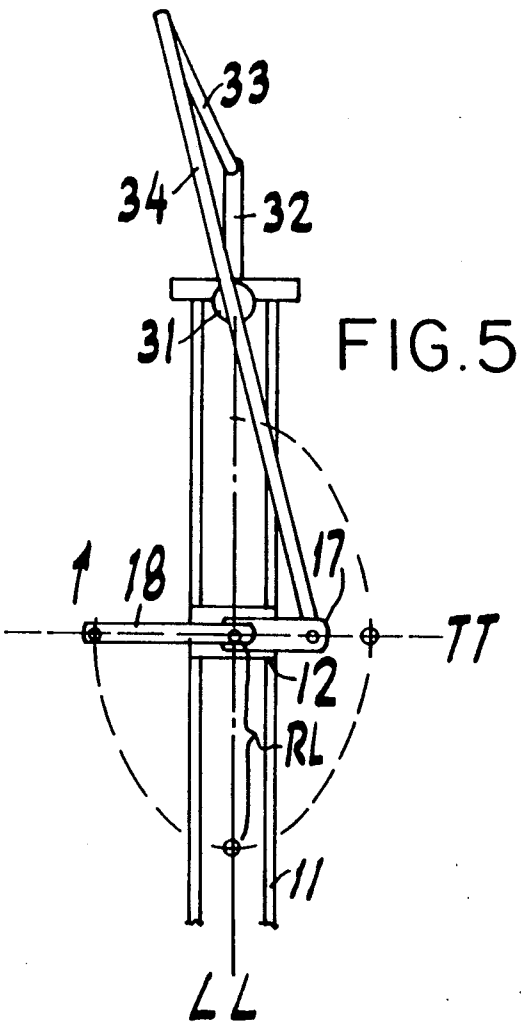
Figure 5C:
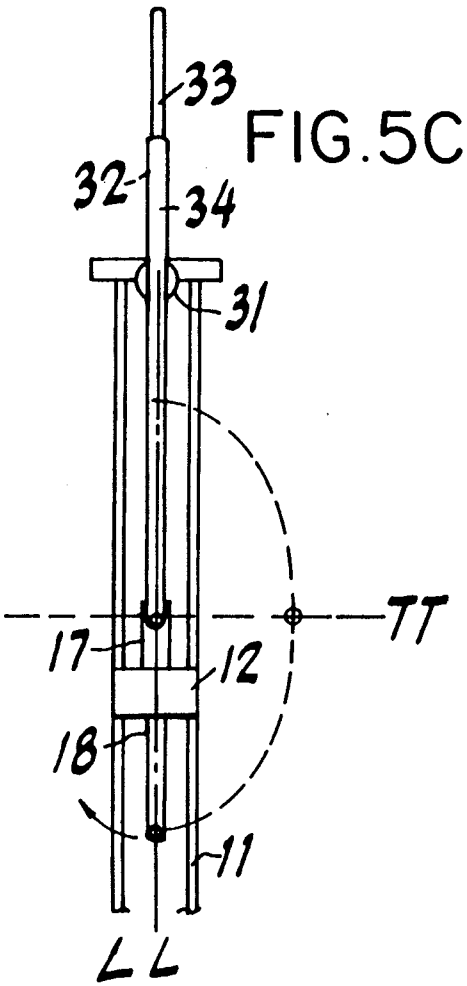
Figure 5B:
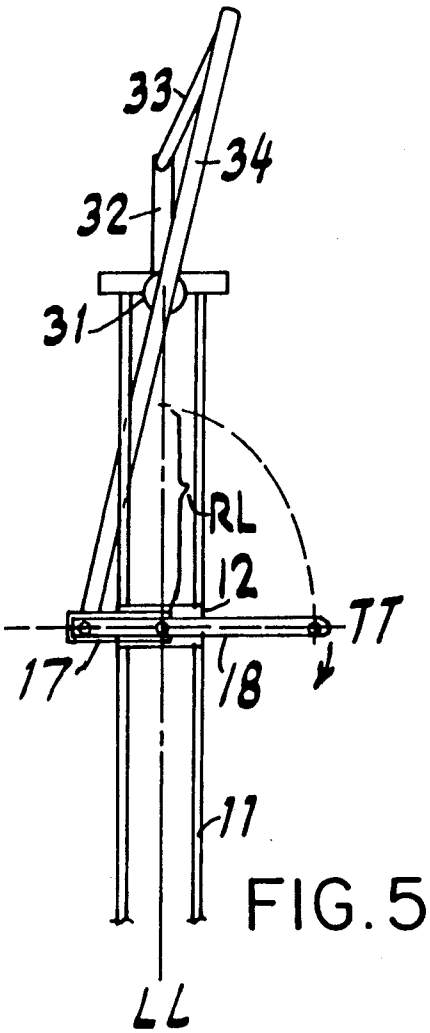

In FIG. 6, the radius geometry of the stright line motion mechanism of the invention is illustrated through a sequence of positions. As the guiding arm 34 is retained in intersection with the pivot point defined by the pivot member 31 and is slidable along the retaining channel 31*b*, the geometry of the extension member (length E), swing arm (length S), and guiding arm (K+E+S) ensures that the end of the guiding arm (hole 34*b* for coupling pin 21) is constrained to lie along the straight line of the transverse axis TT for the full range of positions of the straight line motion mechanism.

An additional feature of the invention is the ability to manipulate the handle to lift the stylus from the drawing surface in order to draw partial ellipses or elliptical arcs. As shown in FIG. 2, when the handle 14 is pushed downward about pivot point PA (in the direction of the double-headed arrow), the crank portion 15 is lifted upward and, by virtue of its connection through connection pin 16, lifts the first arm 17 by compressing the spring 16*c* between the collar 16*b* and the carriage 12. The first arm accordingly lifts the second arm 18 and the stylus 22 with it. The stylus is returned in contact with the drawing surface simply by restoring the handle 14 to its neutral position. As a further feature, a template or ruler, with a marking of the center position (at P2) of the ellipses to be drawn, may be provided between the end supports.

The ellipsograph structure of the invention is readily adapted to a wide range of applications. The ellipsograph can be formed and dimensioned as a portable drafting instrument. Particular features include the collapsible handle for convenient storage, and friction (rubber, felt, etc.) strips on the bases of the end supports. It can also be designed as a drafting tool with one end support held on a positioning arm coupled to a stationary mount on a drafting table, and the other end support as a leg or base freely movable over the drafting surface. The ellisograph may be adpated as a machine or cutting tool with the stylus constituted as a cutting bit, flame jet, laser, or pressurized water or gas jet. The desired ellipse dimensions may be set digitally under machine control, by a rotational stepper drive for the driving member 13 and linear actuators for the blocks 19 and 20. The ellipsograph of the present invention is particularly advantageous for a drafting instrument or machine tool because of its relatively simple construction, the ability for mounting the straight line motion mechanism from only one end support, and the ability to leave the entire space under the tool open except for the stylus itself.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. An ellipsograph structure comprising:

a pair of end supports, a longitudinal member extending therebetween along a longitudinal axis over an area where an ellipse is to be drawn, a carriage member slidably supported on said longitudinal member and having a rotatable driving member mounted thereon, wherein upon rotation said driving member supported on said carriage can freely slide on said longitudinal member along said longitudinal axis, a first arm and a second arm, said first arm having one end thereof fixedly coupled by a first pin connection to said driving member and an opposite end fixedly coupled by a second pin connection to one end of said second arm, a stylus fixed to an opposite end of said second arm, and a straight line motion mechanism mounted to one of said end supports for constraining movement of the second pin connection between said first and second arms on a straight line along a transverse axis perpendicular to said longitudinal axis upon rotation of said driving member, wherein said straight line motion mechanism includes a pivot member mounted to said one end support at a fixed pivot point along said longitudinal axis, an extension member mounted to said one end support having a distal end extending a first length therefrom in alignment with said longitudinal axis, a swing arm having a second length with one end thereof pivotally coupled to said distal end of said extension member, and a guiding arm having a third length longer than the sum of said first and second lengths with one end thereof pivotally coupled to an opposite end of said swing arm and an opposite end thereof pivotally coupled to said second pin connection between said first and second arms, said pivot member having a retaining channel formed therein intersecting said pivot point in which said guiding arm is slidably retained for sliding movement at all times intersecting said pivot point in conjunction with rotation of said driving member and movement of said second pin connection along said transverse axis.

2. An ellipsograph structure according to claim 1, wherein said driving member includes means for allowing said stylus to be lifted from its drawing position, including a handle coupled around a pivot point to a crank portion coupled to said first arm.

3. An ellipsograph structure according to claim 1, wherein said handle is coupled to said crank portion with a hinge for folding said handle to a storage position.

4. An ellipsograph structure according to claim 1, wherein said longitudinal member is formed by a pair of rails having ends mounted to said end supports, and said carriage member has a pair of slide bores for sliding on said rails.

5. An ellipsograph structure according to claim 1, wherein said first and second arms each have an extended length and an adjustable block for setting the position of the respectively coupled end of each arm at any desired position along its respective length.

6. An ellipsograph structure according to claim 5, wherein said second pin connection is a coupling pin coupled between the block of said first arm and the block of said second arm.

7. An ellipsograph structure according to claim 1, wherein said pivot member is a pivotable cylindrical block having said retaining channel formed in an upper part thereof for slidably receiving said guiding arm therein.

8. An ellipsograph structure according to claim 1, wherein said straight line motion mechanism is formed as unit, and said extension member includes a portion for mounting said pivot member thereon, and another portion for securing said unit to said one end support.

9. An ellipsograph structure according to claim 8, wherein said extension member is secured to said one end support with said guiding arm extending through a window aperture in said one end support.

10. An ellipsograph structure according to claim 1, adapted as a cutting tool, wherein said stylus is comprised of a cutting member.

11. In an ellipsograph structure having a pair of end supports, a longitudinal member extending therebetween along a longitudinal axis over an area where an ellipse is to be drawn, a rotatable driving member supported so as to freely slide on said longitudinal member along said longitudinal axis, a first arm and a second arm, said first arm having one end thereof fixedly coupled to said driving member for rotation therewith and an opposite end fixedly coupled by a connection member to one end of said second arm, and a stylus fixed to an opposite end of said second arm, the improvement comprising:

a straight line motion mechanism mounted to one of said end supports for constraining movement of the connection member between said first and second arms on a straight line along a transverse axis perpendicular to said longitudinal axis upon rotation of said driving member, wherein said straight line motion mechanism includes a pivot member mounted to said one end support at a fixed pivot point along said longitudinal axis, an extension member mounted to said one end support having a distal end extending a first length therefrom in alignment with said longitudinal axis, a swing arm having a second length with one end thereof pivotally coupled to said distal end of said extension member, and a guiding arm having a third length longer than the sum of said first and second lengths with one end thereof pivotally coupled to an opposite end of said swing arm and an opposite end thereof pivotally coupled to said connection member between said first and second arms, said pivot member having retaining means by which said guiding arm is slidably retained for sliding movement at all times intersecting said pivot point in conjunction with rotation of said driving member and movement of said connection member along said transverse axis.

12. An ellipsograph structure according to claim 11, wherein said driving member includes means for allowing said stylus to be lifted from its drawing position, including a handle coupled around a pivot point to a crank portion which is coupled to said first arm.

13. An ellipsograph structure according to claim 12, wherein said handle is coupled to said crank portion with a hinge for folding said handle to a storage position.

14. An ellipsograph structure according to claim 11, wherein said longitudinal member is formed by a pair of rails having ends mounted to said end supports.

15. An ellipsograph structure according to claim 11, wherein said first and second arms each have an extended length and an adjustable block for setting the position of the respectively coupled end of each arm at any desired position along its respective length.

16. An ellipsograph structure according to claim 15, wherein said connection member is a coupling pin coupled between the block of said first arm and the block of said second arm.

17. An ellipsograph structure according to claim 11, wherein said pivot member is a pivotable cylindrical block having a retaining channel formed in an upper part thereof for slidably receiving said guiding arm therein.

18. An ellipsograph structure according to claim 11, wherein said straight line motion mechanism is formed as unit, and said extension member includes a portion for mounting said pivot member thereon, and another portion for securing said unit to said one end support.

19. An ellipsograph structure according to claim 18, wherein said extension member is secured to said one end support with said guiding arm extending through a window aperture in said one end support.

20. An ellipsograph structure according to claim 11, adapted as a cutting tool, wherein said stylus is comprised of a cutting member.

* * * * *